US008708193B1

(12) United States Patent
Davis

(10) Patent No.: US 8,708,193 B1
(45) Date of Patent: Apr. 29, 2014

(54) VENDING MACHINE

(76) Inventor: Andrew Davis, Columbia, SD (US)

( * ) Notice: Subject to any disclaimer, the term of this patent is extended or adjusted under 35 U.S.C. 154(b) by 278 days.

(21) Appl. No.: 13/298,213

(22) Filed: Nov. 16, 2011

(51) Int. Cl.
*G07F 11/02* (2006.01)

(52) U.S. Cl.
USPC ..... 221/150 R

(58) Field of Classification Search
USPC ..... 221/150 R, 150 HC
See application file for complete search history.

(56) References Cited

U.S. PATENT DOCUMENTS 3,653,541 A * 4/1972 Crum ..... 221/150 HC
6,389,822 B1 * 5/2002 Schanin ..... 221/150 R
6,478,187 B2 * 11/2002 Simson et al. ..... 221/75
6,695,166 B2 * 2/2004 Long ..... 221/14
7,228,989 B2 * 6/2007 Bhatti et al. ..... 221/150 R
8,121,727 B2 * 2/2012 Mosey ..... 221/150 R

* cited by examiner

*Primary Examiner* — Timothy Waggoner
(74) *Attorney, Agent, or Firm* — Gulf Coast Intellectual Property Group

(57) ABSTRACT

A vending machine having an internal storage compartment operable to store beverage containers wherein the internal storage compartment is configured to utilize thermal transfer to maintain the beverage containers at a temperature that is lower than that of the external surroundings of the vending machine. The vending machine further includes a control panel operable to facilitate sales transactions for the beverage containers stored within the internal storage compartment wherein the control panel further includes a credit card acceptance apparatus. The internal storage compartment further includes four walls having a plurality of layers and further includes a plurality of dividers forming beverage container columns. A cooling apparatus is included having a condenser, a distribution manifold and a network of coolant tubes wherein a portion of the network of coolant tubes are disposed within the plurality of dividers.

14 Claims, 3 Drawing Sheets

VENDING MACHINE

FIELD OF THE INVENTION

The present invention relates to food and beverage distribution devices, more specifically but not by way of limitation a vending machine operable to accept a plurality of different currency formats including credit cards. Additionally, the vending machine includes a cooling system that utilizes thermal conductivity methodology to maintain an internal temperature that is dissimilar to its environment.

BACKGROUND

Vending machines are utilized in numerous locations from businesses, schools and other public area to provide a point of sale for either a beverage or a food item. Vending machines are utilized by merchandisers as an access point to provide a customer a place to purchase an item without the need for personnel or assistance from individuals that may work at or proximate the location of the vending machine. The enhanced convenience of vending machines has led to their success and placement in a multitude of locations. Typical vending machines exist in a variety of configurations and are operable to make available for purchase and dispense items such as but not limited to food snacks or beverages.

One common function for beverage vending machines is to provide cooling for the contents stored therein. Cooling not only enhances the storage life of the product stored within the vending machine, it provides a more desirable product to the user, as cold beverages are more marketable in a warm climate. One problem with conventional cooling systems for existing vending machines is the utilization of air distribution within the interior to cool the contents stored therein. In climates such as warehouses or outdoors, this cooling method results in the consumption of excess energy as well as inconsistent temperature control within the interior of the vending machine. Areas of the vending machine that are closer to the exterior will typically be several degrees warmer.

Another problem with conventional vending machines is their inability to accept a variety of payment methods for the items stored therein. Conventional vending machines utilize payment modules that are configured to accept either paper or coin currency formats. Many individuals no longer utilize conventional currency on a daily basis and are unable to purchase items from conventional vending machines having a payment module that accepts paper or coin currency format. Most consumers routinely utilize a credit or debit card to pay for and subsequently manage the majority of their expenses.

Accordingly, there is a need for a vending machine that is configured with a cooling system that provides consistent temperature across the interior volume of the vending machine while reducing energy consumption. Furthermore, there is a need for a vending machine that is operable to accept a variety of currency formats such as but not limited to paper, coin and credit cards.

SUMMARY OF THE INVENTION

It is the object of the present invention to provide a vending machine operable to provide cooling of the interior storage container without air distribution.

Another object of the present invention is to provide a vending machine that is operable to provide cooling to the contents therein utilizing a distribution of coolant tubes that will maintain the temperature of beverage containers at a temperature that is lower than that of the environmental surroundings through thermal conductivity.

Yet a further object of the present invention is to provide a vending machine that includes a payment-processing module that is operable to accept credit or debit cards.

Still another object of the present invention is to provide a payment processing module that utilizes a magnetic strip reader for credit cards that is configured to accept credit cards in a laterally slidable manner.

Yet another object of the present invention is to provide a vending machine having a payment-processing module that is operably connected to a merchant account so as to approve authorization of the sale of merchandise.

An additional object of the present invention is to provide a vending machine that includes a payment-processing module that includes a graphical interface screen that provides information to the user.

A further object of the present invention is to provide a vending machine that has a network of coolant tubes disposed within the storage racks of the interior compartment.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
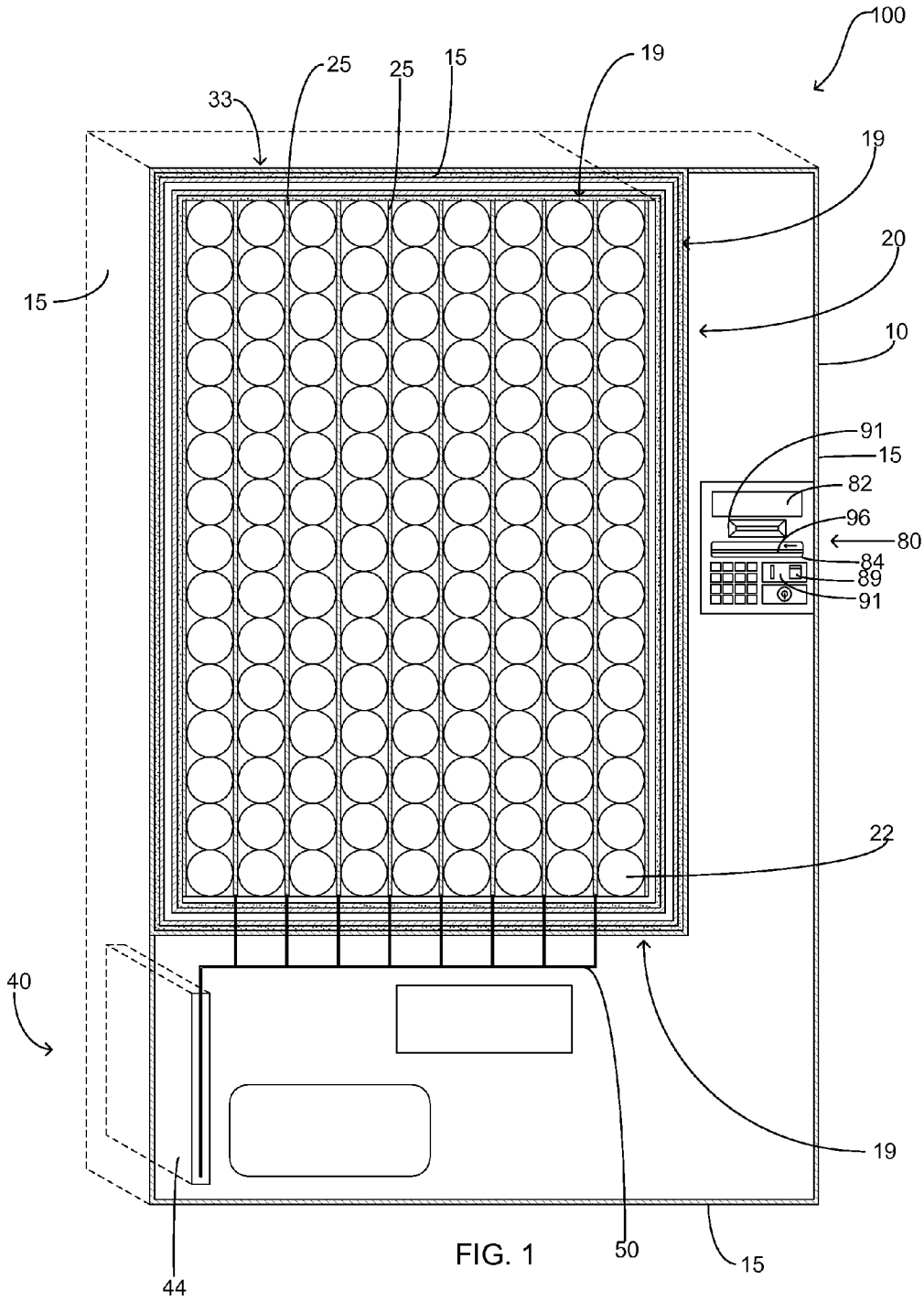
FIG. 1 is front diagrammatic view of the present invention.

Referring now to the drawings submitted herewith, wherein various elements depicted therein are not necessarily drawn to scale and wherein through the views and figures like elements are referenced with identical reference numerals, there is illustrated a vending machine 100 constructed according to the principles of the present invention.

The vending machine 100 further includes a frame 10 constructed of a suitable durable material such as but not limited to metal. The frame 10 includes a plurality of walls 15 that are integrally formed to create the shape of the vending machine 100. While the shape of the preferred embodiment herein is generally rectangular in shape, it is contemplated within the scope of the present invention that the frame 10 could be comprised of a plurality of walls 15 joined to form numerous different shapes.

An internal compartment 20 is disposed within the frame 10 having a plurality of walls 19 and functions to provide storage for items to be sold from the vending machine 100. Exemplary beverage containers 22, such as but not limited to aluminum cans, are illustrated herein stored in a generally vertical manner for selection by a consumer. While the preferred embodiment of the vending machine 100 is configured to store and dispense beverages, it is contemplated within the scope of the present invention that the internal compartment 20 could be configured to store and dispense a variety of beverage or snack items. The internal storage compartment 20 includes a plurality of dividers 25. The dividers 25 are manufactured from a suitable durable material such as but not limited to metal. The dividers 25 include a first wall 26 and a second wall 27 having a void 28 therebetween. The void 28 is of suitable size to accommodate a coolant tube 30 therein. The dividers 25 function to provide cooling to the exemplary beverage containers 22 utilizing thermal conductivity instead of regulating the atmosphere temperature of the entire internal storage compartment 20. The dividers 25 are spaced so as to create a container column 33 of suitable width to accommodate an exemplary beverage container 22 such that the exemplary beverage container 22 will slidably traverse in a downward direction as the exemplary beverage containers 22 are dispensed by the vending machine 100. The container column 33 is manufactured of such a width that the exemplary beverage container 22 will contain the first wall 26 and second wall 27 of adjacent dividers 25. The contact of the exemplary beverage container 22 with the first wall 26 and second wall 27 of adjacent dividers 25 allows for the temperature of the dividers 25 to be transferred to the exemplary beverage containers 22 through utilization of thermal conductivity. The coolant tubes 30 disposed within the dividers 25 contain therein a conventional cooling liquid in a gas form which functions to lower the temperature of the dividers 25 to a desirable temperature that is lower than that of the environmental surroundings of the vending machine 100. As the exemplary beverage containers 22 are adjacent to and contacting the dividers 25, a thermal transfer of energy occurs between the dividers 25 and the exemplary beverage containers 22 until a thermal equilibrium is achieved. This functions to maintain the temperature of the exemplary beverage containers 22 without the need for controlling the temperature of the internal atmosphere of the vending machine 100.

The cooling system 40 includes a conventional condenser 44 and compressor (not illustrated herein) that distributes a coolant within the cooling system 40 and alters the phase of the coolant from a gas to a liquid and returns to a gas inside the coolant tubes 30 within the dividers 25 so as to regulate the temperature of the dividers 25. While not illustrated herein, it is contemplated within the scope of the present invention that a conventional temperature regulator could be interfaced with the cooling system 40 to provide an interface to control the temperature of the dividers 25 at a desired temperature. A distribution manifold 50 operably couples the coolant tubes 30 disposed within the dividers 25 to the condenser 44 and is constructed of suitable durable materials. The distribution manifold 50 distributes the coolant exiting the condenser 44 to each of the dividers 25 disposed within the internal compartment 20. Additionally, the distribution manifold 50 provides a common return for the coolant to the condenser 44. The distribution of the coolant by the distribution manifold 50 is executed in a parallel manner such that the coolant is distributed to the dividers 25 at the same time. Those skilled in the art will recognize that the distribution manifold 50 could be manufactured from numerous different materials and in numerous configurations to perform the desired functionality as described herein.

Figure 4:
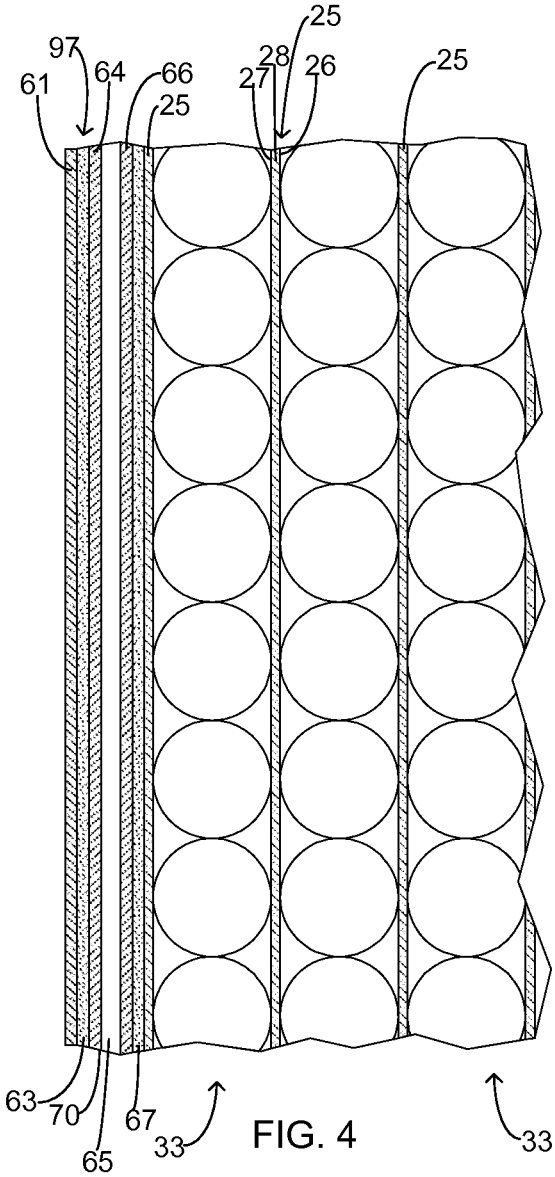
FIG. 4 is a detailed view of the insulative layers and divider racks of the internal storage compartment.

The walls 19 of the internal storage compartment 20 include a multitude of layers 60 that functions to provide thermal isolation thereof. As shown in particular in FIG. 4, the outer layer 61 comprises the exterior of the vending machine 100 and is manufactured of a suitable corrosive resistance metal. Adjacent to the outer layer 61 is an insulative layer 63. The insulative layer 63 functions to substantially inhibit the transfer of heat energy into the internal compartment 20. While no specific material is required for the insulative layer 63, good results have been achieved utilizing extruded polystyrene. Next to the insulative layer 63 is a third layer 64. The third layer 64 and fifth layer 66 are manufactured of a suitable durable material such as but not limited to galvanized metal. Intermediate the third layer 64 and fifth layer 66 is a void 65. The void 65 is substantially hollow having a drain aperture 70. The void 65 functions to control condensation formation and upon formation of condensation on the fifth layer 66, the void 65 functions to provide a passage for the condensation to move downward and out of the internal compartment via the drain aperture 70. While not illustrated herein, it is contemplated within the scope of the present invention that the internal compartment 20 be configured with either a drain hose or drain pan to collect any condensation direct the condensation to an external location from the vending machine 100. Adjacent to the fifth layer 66 is a second insulative layer 67 that is constructed of the same material as insulative layer 63. It is contemplated within the scope of the present invention that numerous configurations of the layers 97 could be utilized and achieve the desired functionality as described herein. More specifically but not by way of limitation, the internal storage compartment 20 could have as few as three layers.

The vending machine 100 further includes a control panel 80. The control panel 80 contains the required electronics to store, receive, manipulate and transmit data as required to control the operation of the vending machine 100. The control panel 80 functions as the interface to process an order and receive currency in exchange for an exemplary beverage container 22 to be distributed to a user of the vending machine 100. The control panel 80 further includes a screen 82. The screen 82 is a conventional LCD screen that is configured to display information to a user of the vending machine. For example but not by way of limitation, the screen 82 will display the price of a particular item stored within the internal compartment 20. Additionally, the screen 82 will display information required to be displayed to the user during the purchase process such as but not limited to order summary, total currency required or credit card authorization status. Those skilled in the art will recognize that the screen 82 could be configured in numerous different sizes.

Figure 3:
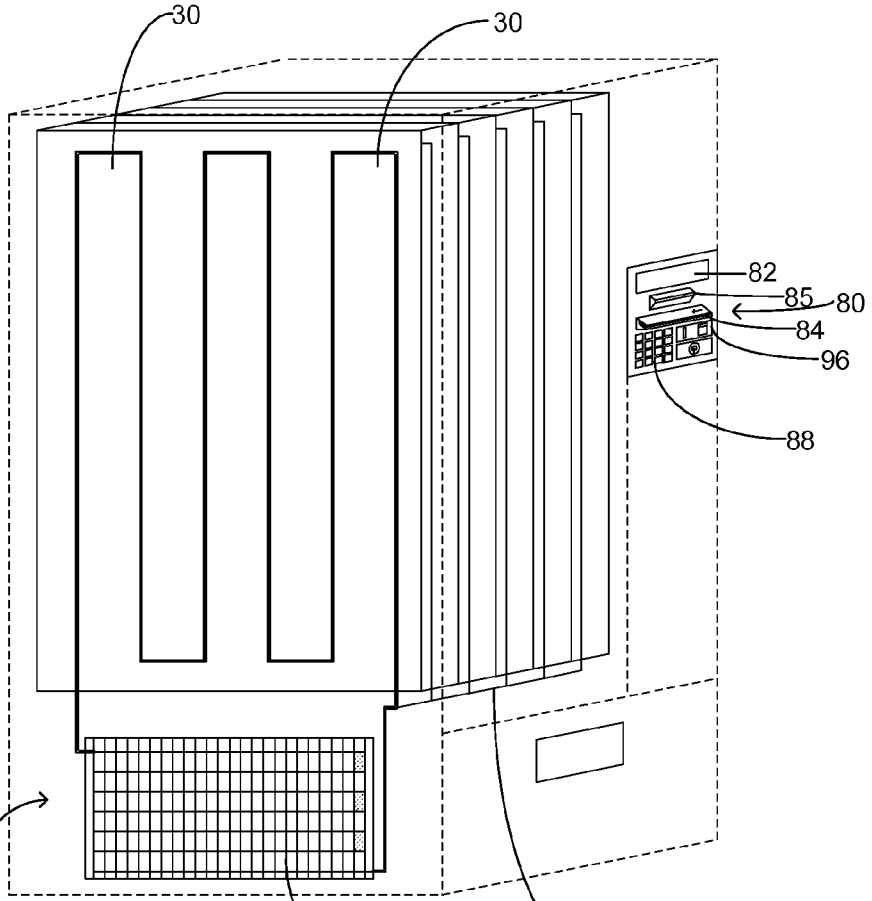
FIG. 3 is a side diagrammatic view of the present invention illustrating the cooling system components.
Figure 2:
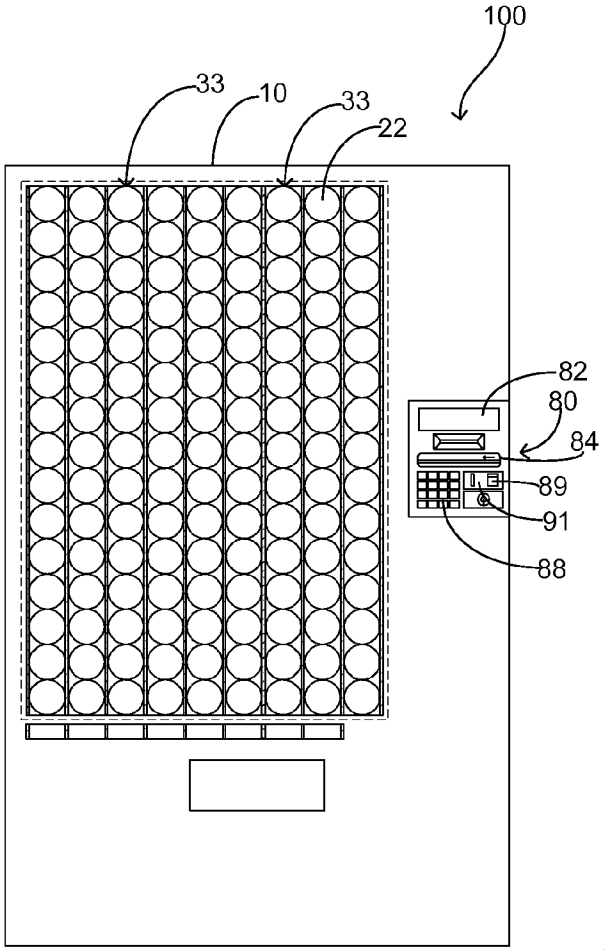
FIG. 2 front view of the present invention illustrating the control panel and internal beverage container rack.

The control panel 80 further includes a credit card terminal slot 84. The credit card terminal slot 84 is a conventional magnetic strip reader that facilitates the inputting of a credit or debit card data to pay for the transaction. The control panel 80 includes the necessary electronics to process credit or debit cards and further includes an external connection that allows the control panel to transmit the received credit or debit card information to a merchant account clearance center to authorize the transaction of the sale. It is contemplated within the scope of the present invention that the control panel 80 includes either a conventional wired or wireless LAN connection so as to facilitate connection with a merchant account clearance center in order to process the inputted credit or debit card. Subsequent to the user laterally sliding their credit or debit card to pay for the transaction, the control panel 80 will transmit the inputted data from the magnetic strip of the credit or debit card for acceptance. The control panel 80 will pause the transaction in order to receive information from the merchant account clearance center. Ensuing receipt of the credit or debit card transaction approval or rejection, the control panel 80 will display the information to the user via the screen 82. As shown in particular in FIG. 3, the credit card terminal slot 84 is configured at an angular manner with respect to the control panel 80. More specifically, the car receiving channel 96 of the credit card terminal slot 84 is constructed such that it is mounted at a downward angle of approximately forty-five degrees with respect to the control panel 80. The angular mounting of the credit card terminal slot 84 substantially inhibits the introduction of rain or other liquids thereinto. This is particularly desirable when the vending machine 100 is placed in an outdoor area or partially covered area such that the exposure to rain is more probable.

The control panel 80 further includes additional conventional currency format input devices 91. More specifically, a bill input device 85 and a coin input device are operably integrated with the control panel 80 and are configured to accept bill and coin currency formats respectively, to facilitate a sales transaction. A keypad 88 is further included that functions similar to a conventional keypad allowing a user to input a code identifying the item or items desired to be purchased. Those skilled in the art will recognize that the keypad could be configured with numerous different alpha or numeric combinations that correlate to a displayed code for each type of merchandise stored within the internal compartment 20. The control panel 80 further includes a coin return apparatus 89 that will facilitate the return of coins should a user desire to abort the sales transaction or if the vending machine 100 fails to complete the sales transaction.

While a preferred embodiment of the invention has been disclosed herein, it is contemplated within the scope of the present invention that the internal compartment 20, cooling system 40 and control panel 80 could be configured such that they would be packaged as a kit to be retrofitted into existing conventional vending machines so as to provide a different technique of temperature control and facilities the acceptance of credit or debit cards.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A vending machine component kit configured to be retrofitted into an existing conventional vending machine comprising:

an internal storage compartment, said internal storage compartment being substantially rectangular in shape, said internal storage compartment including a plurality of container columns operable to store beverage containers, said internal storage compartment having a plurality of wall layers;

a control panel, said control panel having the necessary electronics to store, receive, manipulate and transmit data, said control panel including a plurality of currency format input apparatus, wherein at least one of said plurality of currency format input apparatus is a credit card input apparatus, said credit card input apparatus operable to facilitate the input of credit or debit cards as a form of currency for a sales transaction, said credit card input apparatus being configured to receive a credit card such that the credit card is laterally slid into said credit card input apparatus, said credit card input apparatus further being mounted in a downward angular manner;

a plurality of dividers, said dividers operable to form said plurality of container columns, said dividers including a first wall and a second wall, said dividers having a void intermediate said first wall and second wall, said void having disposed therein a portion of said network of cooling tubes; and a cooling system, said cooling system including a condenser, said cooling system having a network of cooling tubes, said cooling system operable to maintain said internal storage compartment at a temperature that is lower than that of its environmental surroundings.

2. The vending machine component kit as recited in claim 1, wherein said plurality of wall layers include at least one of the following: galvanized metal or extruded polystyrene.

3. The vending machine component kit as recited in claim 2, wherein said plurality of currency format input apparatus further includes paper currency input apparatus and a coin currency input apparatus.

4. The vending machine component kit as recited in claim 3, wherein said cooling system further includes a distribution manifold, said distribution manifold operably connected to said network of cooling tubes, said distribution manifold operable to distribute coolant to said network of coolant tubes.

5. A vending machine comprising:

a housing, said housing being generally rectangular in shape;

an internal storage compartment, said internal storage compartment including four walls, said internal storage compartment storage compartment further including a plurality of dividers, said plurality of dividers forming a plurality of container columns, said four walls further including a plurality of layers;

a cooling apparatus, said cooling apparatus further including a condenser, said cooling apparatus having a network of coolant tubes, at least a portion of said network of coolant tubes being disposed within said plurality of dividers, said cooling apparatus operable to control the temperature of said plurality of dividers;

a control panel, said control panel being mounted on the exterior of said housing, said control panel having the necessary electronics to store, receive, manipulate and transmit data, said control panel further including a plurality of currency acceptance devices, said plurality of currency acceptance devices including a credit card acceptance device, said credit card acceptance device having a receiving slot, said credit card acceptance device being mounted in an angular manner on said control panel, said credit card acceptance device being mounted at an angle such that said credit card acceptance device is approximately forty-five degrees with respect to said control panel; and wherein said plurality of dividers further include a first wall and a second wall, said plurality of dividers having a void intermediate said first wall and said second wall, at least a portion of said network of coolant tubes being disposed within said void.

6. The vending machine component kit as recited in claim 5, wherein said control panel further includes a LCD screen, said LCD screen operable to provide information to a user to facilitate a sales transaction of a product stored within said internal compartment of the vending machine.

7. The vending machine component kit as recited in claim 6, wherein said plurality of layers being manufactured from at least one of the following: an insulative material or metal.

8. The vending machine component kit as recited in claim 7, and further including a distribution manifold; said distribution manifold operably connected to said network of cooling tubes, said distribution manifold operable to distribute coolant to said network of coolant tubes.

9. A vending machine operable to accept credit cards as payment for a sales transaction wherein the vending machine utilizes thermal transfer to maintain the temperature of the items stored therein available for purchase comprising:

a housing;

an internal storage compartment, said internal storage compartment being disposed within said housing, said internal storage compartment having four walls, said four walls having a first layer, a second layer, a third layer, a fourth layer, a fifth layer and a sixth layer, said internal storage compartment including a plurality of dividers, said plurality of dividers operable to form container columns, said plurality of dividers having a first wall and a second wall, said plurality of dividers further including a void intermediate said first wall and said second wall, said container columns operable to receive a beverage container;

a condenser;

a network of coolant tubes, said network of coolant tubes having at least a portion thereof disposed within said void of said plurality of dividers, said network of coolant tubes operably coupled to said condenser, said network of coolant tubes operable to control the temperature of said plurality of dividers;

a control panel, said control panel having the necessary electronics to store, receive, manipulate and transmit data, said control panel further including a screen, said control panel further including an input keypad;

a credit card input apparatus, said credit card input apparatus integrated with said control panel, said credit card input apparatus operable to facilitate the acceptance of credit cards for a purchase transaction, said credit card input apparatus having a receiving slot, said receiving slot of said credit card input apparatus mounted in an angular manner, said receiving slot operable to receive a credit card in a lateral sliding manner.

10. The vending machine as recited in claim 9, wherein said second layer and said sixth layer are manufactured from an insulative material.

11. The vending machine as recited in claim 10, wherein said first layer, said third layer, said fifth layer are manufactured from galvanized metal.

12. The vending machine as recited in claim 11, and further including a distribution manifold, said distribution manifold operably connected to said network of coolant tubes and said condenser, said distribution manifold operable to distribute coolant to said network of coolant tubes.

13. The vending machine as recited in claim 12, wherein said credit card input apparatus is mounted at an angle such that said receiving slot is approximately forty-five degrees with respect to said control panel.

14. The vending machine as recited in claim 13, wherein said control panel further includes a paper currency input apparatus and a coin currency input apparatus.

* * * * *